United States Patent [19]

Winslow et al.

[11] Patent Number: 4,560,004

[45] Date of Patent: Dec. 24, 1985

[54] DRILL PIPE TESTER - PRESSURE BALANCED

[75] Inventors: Donald W. Winslow; Gary Q. Wray, both of Duncan, Okla.

[73] Assignee: Halliburton Company, Duncan, Okla.

[21] Appl. No.: 615,443

[22] Filed: May 30, 1984

[51] Int. Cl.[4] ..... E21B 34/08

[52] U.S. Cl. ..... 166/321; 166/250; 166/332; 166/334

[58] Field of Search ..... 166/356, 374, 321, 373, 166/334, 317, 323, 332, 320, 120, 250

[56] References Cited

U.S. PATENT DOCUMENTS

| | | | |
|---|---|---|---|
| Re. 27,464 | 8/1972 | Taylor, Jr. | 166/362 |
| Re. 29,471 | 11/1977 | Grioux | 166/334 |
| 3,568,715 | 2/1968 | Taylor, Jr. | 137/613 |
| 3,856,085 | 12/1974 | Holden et al. | 166/264 |
| 3,967,647 | 6/1976 | Young | 137/614.11 |
| 4,009,753 | 3/1977 | McGill et al. | 166/55.1 |
| 4,064,937 | 12/1977 | Barrington | 166/321 X |
| 4,116,272 | 9/1978 | Barrington | 166/340 |
| 4,270,610 | 6/1981 | Barrington | 166/317 |
| 4,319,633 | 3/1982 | McMahan et al. | 166/250 |
| 4,421,172 | 12/1983 | McMahan | 166/334 |
| 4,445,571 | 5/1984 | Hushbeck | 166/332 X |
| 4,452,313 | 6/1984 | McMahan | 166/323 X |
| 4,458,762 | 7/1984 | McMahan | 166/373 |
| 4,460,040 | 7/1984 | Bowyer | 166/324 X |
| 4,489,786 | 12/1984 | Beck | 166/374 |

*Primary Examiner*—James A. Leppink
*Assistant Examiner*—David J. Bagnell
*Attorney, Agent, or Firm*—James R. Duzan; Thomas R. Weaver

[57] ABSTRACT

A spherical valve member type having a drill pipe tester valve and a moving apparatus to provide for moving the spherical valve member axially relative to the housing between its said open and closed positions, thereby permitting downward forces exerted upon the spherical valve member in its said closed position due to fluid pressure in the well test string above the spherical valve member, to be transmitted substantially entirely to the housing through the engagement of the downward facing surface of the lower valve seat structure and the upward facing surface of the housing. A latch device is provided for latching the spherical valve member in its closed position as the well test string is lowered into the well and for subsequently releasing the spherical valve member and allowing it to move to its open position when the well test string is finally positioned within the well. A resilient means is provided to prevent movement of the spherical valve member to its open position until a predetermined force is applied to the tester valve. A pressure compensating piston assembly is provided to compensate for the volume decrease of the tester valve during actuation thereof. Upon picking up the well test string the latching device provides a safety valve feature by moving the spherical valve member back to its closed position.

8 Claims, 6 Drawing Figures

DRILL PIPE TESTER - PRESSURE BALANCED

BACKGROUND OF THE INVENTION

The present invention is directed to improved drill pipe tester valves and, more particularly, to improved drill pipe tester valves designed to be used above a formation tester valve in a well test string and of the type described in U.S. Pat. No. 4,421,172.

During the course of drilling an oil well, one operation which is often performed is to lower a testing string into the well to test the production capabilities of the hydrocarbon producing underground formations intersected by the well. This testing is accomplished by lowering a string of pipe, commonly referred to as a drill string, into the well with a formation tester valve attached to the lower end of the string of pipe and oriented in a closed position, and with a packer attached below the formation tester valve. This string of pipe with the attached testing equipment is generally referred to as a well test string.

Once the test string is lowered to the desired final position, the packer means is set to seal off the annulus between the test string and a well casing, and the formation tester valve is opened to allow the underground formation to produce through the test string.

During the lowering of the test string into the well, it is desirable to be able to pressure test the string of drill pipe periodically so as to determine whether there is any leakage at the joints between successive stands of drill pipe.

To accomplish this drill pipe pressure testing, the string of drill pipe is filled with a fluid and the lowering of the pipe is periodically stopped. When the lowering of the pipe is stopped, the fluid in the string of drill pipe is pressurized to determine whether there are any leaks in the drill pipe above the formation tester valve.

With the apparatus and methods generally used in the prior art for testing the drill pipe as it is lowered into the well, the fluid in the string of pipe is generally contained within the drill pipe only by the closure of the formation tester valve. In other words, the pressure exerted on the fluid in the drill pipe is also exerted against the closed formation tester valve.

This prior art arrangement has often been utilized with a formation tester valve similar to that shown in U.S. Pat. No. 3,856,085 to Holden, et al assigned to the assignee of the present invention. The Holden, et al formation tester valve has a spherical valve member contained between upper and lower valve member seats.

The Holden, et al formation tester valve is shown only schematically in U.S. Pat. No. 3,856,085, and the details of the mounting of the spherical valve member within the housing of the valve are not thereshown. The actual formation tester valve constructed according to the principles of Holden, et al U.S. Pat. No. 3,856,085 has the upper valve seat for the spherical valve member suspended from an inner mandrel which is hung off an annular shoulder of the outer valve housing, in a manner similar to that shown in U.S. Pat. No. Re. 29,471 to Giroux, and assigned to the assignee of the present invention. The lower valve seat is connected to the upper valve seat by a plurality of C-clamps spanning around the spherical valve member. The lower valve seat member of the Holden, et al formation tester valve does not, therefore, engage any supporting portions of the valve housing.

The spherical valve member of the Holden, et al formation tester valve is held in place within the housing so as to prevent axial movement of the spherical valve member relative to the housing, and is engaged by eccentric lugs mounted on a sliding member which does move axially relative to the housing so that upon axial movement of the lugs relative to the housing, the spherical valve member is rotated relative to the housing to open and close the valve.

When pressure testing drill pipe located above a formation tester valve like that of Holden, et al, experience has shown that excessive pressure exerted upon the top surface of the spherical valve member of the Holden, et al apparatus, causes the spherical valve member to exert a downward force on the eccentric lugs thereby shearing the eccentric lugs off their carrying member. This severely limits the maximum pressure which may be exerted upon the fluid within the drill pipe to pressure test the same, and it is particularly a significant problem in very deep wells where the mere hydrostatic pressure of the fluid within the drill pipe is relatively high. It has been determined that the maximum differential pressure which can safely be carried by the Holden, et al valve is about 5000 psi.

Another prior art valve having a spherical valve member which does not move axially relative to its housing is the subsea test tree valve shown in U.S. Pat. No. 4,116,272 to Barrington.

Other prior art valves having a spherical valve member which does move axially relative to the housing are shown in U.S. Pat. No. 4,064,937 to Barrington; U.S. Pat. No. 3,568,715 to Taylor, Jr.; U.S. Pat. No. Re. 27,464 to Taylor, Jr.; U.S. Pat. No. 4,009,753 to McGill, et al; and U.S. Pat. No. 3,967,647 to Young.

A drill pipe tester valve which may be run in the well test string directly above a formation tester valve such as that of Holden et al, U.S. Pat. No. 3,856,085, is shown in McMahan et al, U.S. Pat. No. 4,319,633. While such a drill pipe tester valve has a spherical valve member which can withstand high differential pressure thereacross, the spherical valve member may be opened prematurely through the application of force to the lower adapter when lowering the well test string into the well bore.

The drill pipe tester valve described in U.S. Pat. No. 4,421,172 provides a drill pipe tester valve which is run in the well test string directly above a formation tester valve such as that of Holden et al, U.S. Pat. No. 3,856,085. This drill pipe tester valve overcomes the difficulties encountered due to pressure testing directly against the formation tester valve. The drill pipe tester valve has a lower valve seat which is supportably engaged by the valve housing, so as to prevent downward forces from being exerted upon the eccentric actuating lugs thereof when the fluid in the drill pipe is pressurized, thereby preventing the shearing of those lugs on the drill pipe tester valve. The drill pipe tester valve can withstand differential pressures up to 10,000 psi. The drill pipe tester valve further includes a resilient spring to prevent movement of the spherical valve members to its open position until a predetermined force is applied to the drill pipe tester valve.

However, the drill pipe tester valve described in U.S. Pat. No. 4,421,172 suffers from the problems of either bypass seal cutting during closing of the bypass when the ball valve is opening before the completed closing of the bypass seal or the creation of a pressure trap requiring compression of the fluid between the closed ball valve in the drill pipe tester valve and any closed tester valve run therebelow when the bypass seals are completely closed before the opening of the ball valve in the drill pipe tester valve.

STATEMENT OF THE INVENTION

In contrast to these prior art drill pipe tester valves, the drill pipe tester valve of the present invention is pressure balanced to compensate for the decrease in the volume of the drill pipe tester valve during actuation thereof.

The drill pipe tester valve of the present invention has a housing having a first end adapted to be connected to the string of drill pipe, which housing has a flow passage therethrough. A spherical valve member is disposed in the flow passage of the housing. Lug means are attached to the housing for engaging the spherical valve member and rotating the spherical valve member between open and closed positions wherein the flow passage of the housing is open and closed, respectively, as the spherical valve member is moved axially relative to the housing and the lug means.

Moving means are provided for moving the spherical valve member axially relative to the housing between its said open and closed positions, which moving means includes a lower valve member seat means having a downward facing surface supportably engaged by an upward facing surface of the housing when the spherical valve member is in its said closed position. This permits downward forces exerted upon the spherical valve member in its said closed position due to fluid pressure in the string of drill pipe above the spherical valve member, to be transmitted substantially entirely to the housing through the engagement of the downward facing surface of the lower valve seat means and the upward facing surface of the housing.

A latch means is also provided for latching the spherical valve member in its said closed position as said string of pipe and drill pipe tester valve are lowered into the well. The latch means releases the spherical valve member and allows it to move to its open position during the formation testing procedures. After the formation testing procedures are completed, or at any other time when the weight of the well test string is picked up, the latch means provides a means for moving the spherical valve member back to its closed position thereby providing a safety valve feature in addition to the drill pipe testing feature of the drill pipe tester valve of the present invention.

A resilient annular spring is provided to prevent movement of the spherical valve member to its open position until a predetermined force is applied to the drill pipe tester valve of the present invention.

An automatic pressure compensating piston assembly is contained in the lower portion of the tester valve of the present invention to compensate for the decrease in the volume of the drill pipe tester valve during actuation.

Numerous features and advantages of the present invention will be readily apparent to those skilled in the art upon a reading of the following disclosure when taken in conjunction with the accompanying drawings.

DETAILED DESCRIPTION OF THE INVENTION

During the course of drilling an oil well, the borehole is filled with a fluid known as drilling fluid or drilling mud. One of the purposes of this drilling fluid is to contain in intersected formations any formation fluid which may be found there. To contain these formation fluids the drilling mud is weighted with various additives so that the hydrostatic pressure of the mud at the formation depth is sufficient to maintain the formation fluid within the formation without allowing it to escape into the borehole.

When it is desired to test the production capabilities of the formation, a testing string is lowered into the borehole to the formation depth and the formation fluid is allowed to flow into the string in a controlled testing program.

Sometimes, lower pressure is maintained in the interior of the testing string as it is lowered into the borehole. This is usually done by keeping a formation tester valve in the closed position near the lower end of the testing string. When the testing depth is reached, a packer is set to seal the borehole thus closing in the formation from the hydrostatic pressure of the drilling fluid in the well annulus. The formation tester valve at the lower end of the testing string is then opened and the formation fluid, free from the restraining pressure of the drilling fluid, can flow into the interior of the testing string.

Alternatively, rather than lowering a packer concurrently with the testing string and setting the packer before actuation of the testing string, in many instances, a packer has been previously set in the borehole and the testing string merely engages the packer and controls the flow of fluids therethrough during the testing program.

At other times the conditions are such that it is desirable to fill the testing string above the formation tester valve with liquid as the testing string is lowered into the well. This may be for the purpose of equalizing the hydrostatic pressure head across the walls of the test string to prevent inward collapse of the pipe and/or may be for the purpose of permitting pressure testing of the test string as it is lowered into the well.

The well testing program includes periods of formation flow and periods when the formation is closed in. Pressure recordings are taken throughout the program for later analysis to determine the production capability of the formation. If desired, a sample of the formation fluid may be caught in a suitable sample chamber.

At the end of the well testing program utilizing the present invention, a circulation valve in the test string is opened, formation fluid in the testing string is circulated out, and the testing string is withdrawn.

Figure 1:
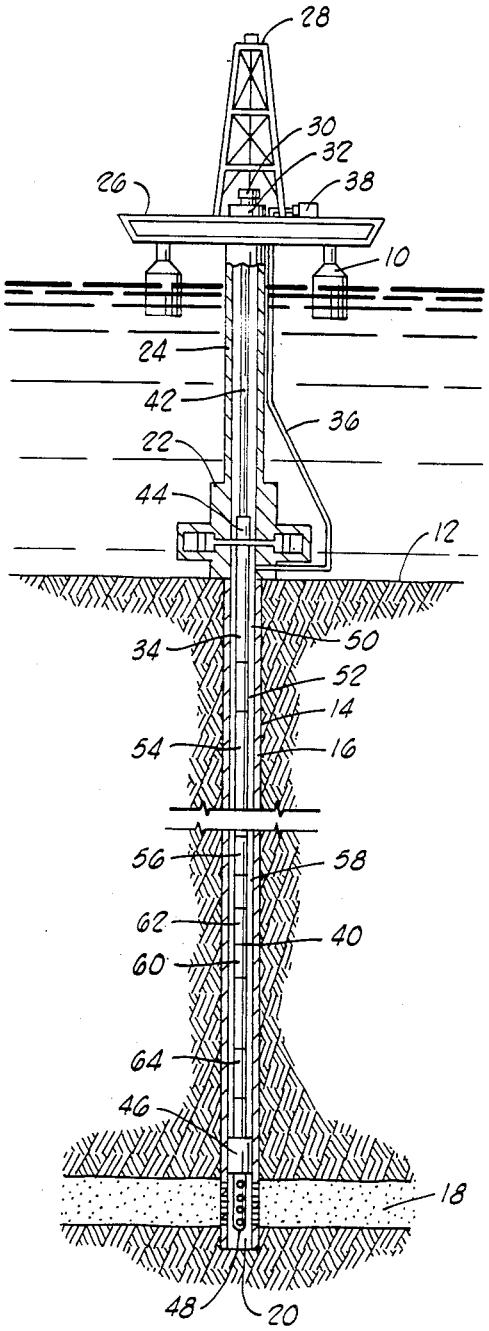
FIG. 1 shows a schematic view of a well test string in place within an offshore well.

A typical arrangement for conducting a drill stem test offshore is shown in FIG. 1. Such an arrangement would include a floating work station 10 stationed over a submerged work site 12. The well comprises a well bore 14 typically lined with a casing string 16 extending from the work site 12 to a submerged formation 18. The casing string 16 includes a plurality of perforations at its lower end which provide communication between the formation 18 and the interior of the well bore 20.

At the submerged well site 12 is located the well head installation 22 which includes blowout preventor mechanisms. A marine conductor 24 extends from the well head installation to the floating station 10. The floating work station 10 includes a work deck 26 which supports a derrick 28. The derrick 28 supports a hoisting means 30. A well head closure 32 is provided at the upper end of marine conductor 24. The well head closure 32 allows for lowering into the marine conductor and into the well bore 14 a formation testing string 34 which is raised and lowered in the well by hoisting means 30.

A supply conduit 36 is provided which extends from a hydraulic pump 38 on the deck 26 of the floating station 10 and extends to the well head installation 22 at a point below the blowout preventors to allow the pressurizing of the well annulus 40 surrounding the test string 34.

The testing string 34 includes an upper conduit string portion 42 extending from the work site 12 to the well head installation 22. A hydraulically operated conduit string test tree 44 is located at the end of the upper conduit string 42 and is landed in the well head installation 22 to thus support the lower portion of the formation testing string. The lower portion of the formation testing string extends from the test tree 44 to the formation 18. A packer mechanism 46 isolates the formation 18 from fluids in the well annulus 40. A perforated tail piece 48 is provided at the lower end of the testing string 34 to allow fluid communication between the formation 18 and the interior of the tubular formation testing string 34.

The lower portion of the formation testing string 34 further includes intermediate conduit portion 50 and torque transmitting pressure and volume balanced slip joint means 52. An intermediate conduit portion 54 is provided for imparting weight to the string.

It is many times desirable to place near the lower end of the testing string a conventional circulation valve 56 which may be opened by rotation or reciprocation of the testing string or a combination of both or by the dropping of a weighted bar in the interior of the testing string 10. Below circulating valve 56 there may be located a combination sampler valve section and reverse circulation valve 58, such as that shown in U.S. Pat. No. 4,064,937 to Barrington and assigned to the assignee of the present invention.

Also near the lower end of the formation testing string 34 is located formation tester valve 60 which is preferably a tester valve of the annulus pressure operated type similar to that disclosed in U.S. Pat. No. 3,856,085 to Holden et al. Immediately above the formation tester valve 60 is located the drill pipe tester valve 62 of the present invention.

A pressure recording device 64 is located below the formation tester valve 60. The pressure recording device 64 is preferably one which provides a full opening passageway though the center of the pressure recorder to provide a full opening passageway through the entire length of the formation testing string.

It may be desirable to add additional formation testing apparatus in the testing string 34. For instance, where it is feared that the testing string 34 may become stuck in the borehole 14 it is desirable to add a jar mechanism between the pressure recorder 64 and the packer assembly 46. The jar mechanism is used to impart blows to the testing string to assist in jarring a stuck testing string loose from the borehole in the event that the testing string should become stuck. Additionally, it may be desirable to add a safety joint between the jar and the packer mechanism 46. Such a safety joint would allow for the testing string 34 to be disconnected from the packer assembly 46 in the event that the jarring mechanism was unable to free a stuck formation testing string.

The location of the pressure recording device may be varied as desired. For instance, the pressure recorder may be located below the perforated tail piece 48 in a suitable pressure recorder anchor shoe running case. In addition, a second pressure recorder may be run immediately above the formation tester valve 60 to provide further data to assist in evaluating the well.

Referring now to the FIGS. 2A–2E, a half-section elevation view is thereshown of the drill pipe tester valve 62 of the present invention.

The drill pipe tester valve 62 includes a housing 66 including an upper adapter 68, a first cylindrical valve casing portion 70, a middle adapter portion 72, and a second valve casing portion 74.

The upper adapter 68 and first cylindrical valve casing portion 70 may generally be referred to as an upper housing portion 76, and the middle adapter portion 72 and second valve casing 74 may collectively be referred to as a lower housing portion 78.

The upper end 80 of lower housing portion 78 is received within a lower end 82 of upper housing portion 76, and attached thereto at threaded connection 84.

Housing 66 has an upper end 86 adapted to be connected to a string of pipe of formation testing string 34 (See FIG. 1) by means of an internally threaded connection 88. In this manner the entire weight of the portions of the test string 34 located below connection 88 is carried by the housing 66. Housing 66 has a flow passage 90 disposed axially therethrough.

Figure 2A:
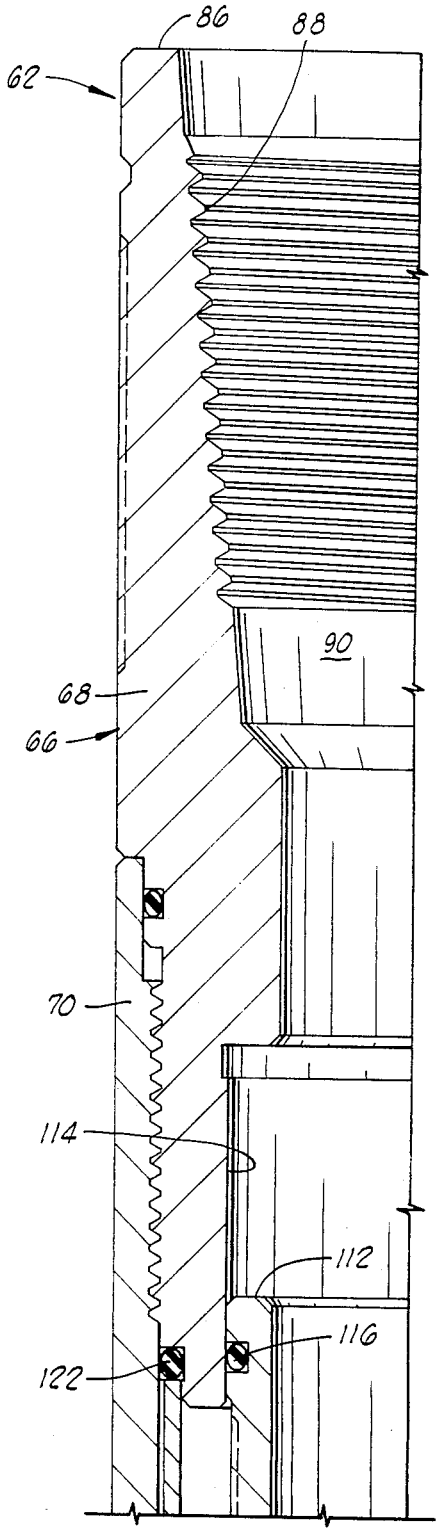
FIGS. 2A–2E show a half-section elevation view of the drill pipe tester valve of the present invention.
Figure 2B:
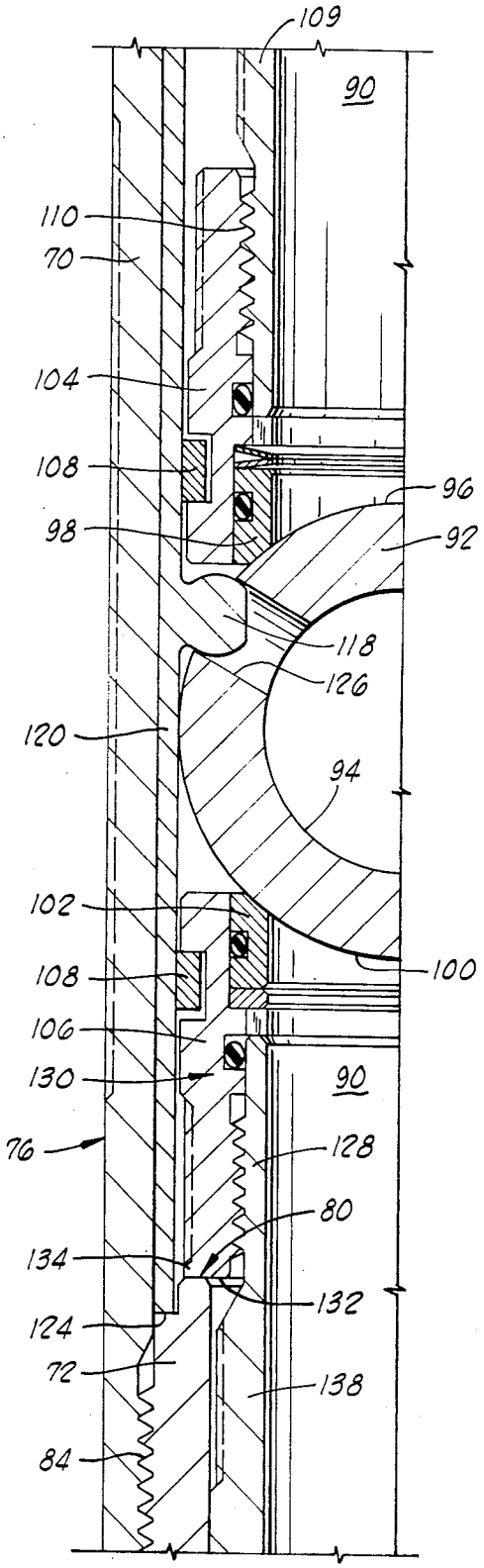

Disposed within flow passage 90 is a spherical valve member 92 which has a valve bore 94 therethrough. Spherical valve member 92 is shown in FIG. 2B in its closed position closing the flow passage 90.

The spherical valve member 92 has its upper surface 96 seated against an upper valve seat 98 and has its lower surface 100 seated against a lower valve seat 102.

The upper valve seat 98 is disposed in an upper valve seat carrier 104 and the lower valve seat 102 is disposed in a lower valve seat carrier 106. The upper and lower valve seat carriers 104 and 106 are connected together by a plurality of C-clamps, such as the clamp 108, two ends of which are shown in FIG. 2B. It will be understood that the C-clamp 108 is a continuous member between the two ends which are illustrated in FIG. 2B, and it therefore holds the valve seat carriers 104 and 106 together about spherical valve member 92.

A positioning mandrel or guide mandrel 109 has its lower end attached to upper valve seat carrier 104 at threaded connection 110 and has an upper end 112 closely received within a cylindrical inner surface 114 of upper adapter 68. An annular seal 116 is disposed between positioning mandrel 109 and inner cylindrical surface 114.

An eccentric lug 118 is attached to a lug carrying mandrel 120 which is received within valve casing 70 and engaged at is upper and lower ends 122 and 124, respectively, by upper adapter 68 and by upper end 80 of middle adapter 72 so that eccentric lug 118 is held in a fixed position relative to housing 66.

The eccentric lug 118 engages an eccentric hole 126 disposed radially through a wall of spherical valve member 92.

A second eccentric lug (not shown) similar to lug 118 also engages another eccentric hole (not shown) of spherical valve member 92 in a manner similar to that shown in FIGS. 4A–4C of U.S. Pat. No. 3,856,085 to Holden et al, the details of which are incorporated herein by reference.

It will be appreciated that the representation of the eccentric lug 118 and mandrel 120, and of the C-clamp 108 are rather schematically shown in FIG. 2B, for purposes of convenient illustration, and that in a true sectional view of the drill pipe tester valve, both the lug 118 and the C-clamp 108 would not be shown in the same sectional view since the two are radially spaced.

When the spherical valve member 92 is moved axially relative to housing 66, in a manner which will be further described below, the engagement of lug 118 with eccentric hole 126 causes the spherical valve member 92 to be rotated relative to housing 66 between open and closed positions wherein flow passage 90 is opened and closed, respectively. The spherical valve member 92 is shown in FIG. 2B in its closed position. By movement of spherical valve member 92 axially upward relative to housing 66 from the position shown in FIG. 2B, the spherical valve member 92 is caused to be rotated toward an open position wherein the valve bore 94 is aligned with the flow passage 90 of housing 66 so as to permit flow of fluid through the flow passage 90 from one end to the other of housing 66.

Moving means generally designated by the numeral 128 are provided for moving spherical valve member 92 axially relative to housing 66. The moving means 128 may be considered as including the lower valve seat carrier 106 and the lower valve seat 102 which may be collectively referred to as a lower valve seat means 130. The lower valve seat means 130 is also sometimes referred to in the following description as a lower valve member seat means.

The lower valve seat carrier 106 includes an annular downward facing surface 132 which is supportably engaged by an upward facing surface 134 of upper end 80 of middle adapter 72 of housing 66 when spherical valve member 92 is in its closed position as illustrated in FIG. 2B. This arrangement permits downward forces exerted upon spherical valve member 92 when in its closed position, due to fluid pressure in the test string 34 above spherical valve member 92, to be transmitted substantially entirely to housing 66 through said engagement of downward facing surface 132 and upward facing surface 134. This provides a very strong support below the spherical valve member 92 so that when the very high fluid pressures from testing of drill pipe are exerted upon the upper surface 96 of spherical valve member 92, those pressures will be transmitted directly to the housing 66 rather than being transmitted to lugs 118 and creating problems of failure of those lugs as was described above with regard to use of prior art devices such as that of Holden et al U.S. Pat. No. 3,856,085.

In the disclosed embodiment the downward facing surface 132 is specifically located upon the lower valve seat carrier 106. It may, however, be generally said to be located upon the lower valve seat means 130, and it will be understood that the physical arrangement of the lower valve seat means 130 could be modified to include additional elements or to integrate seat 102 and seat carrier 106 into a single element. All that is important is that a downward facing surface, such as surface 132, be located upon a structure which structurally supports the spherical valve member 92 from below. Such structure may generally be referred to as a lower valve seat means.

The moving means 128 also includes a moving mandrel means 136 which is comprised of an upper moving mandrel portion 138 and a lower moving mandrel portion 140.

The upper moving mandrel portion 138 and an upper part of the lower moving mandrel portion 140 are reciprocably received within the lower end of housing 66 and are each reciprocable between respective upper and lower positions relative to housing 66. The upper moving mandrel portion 138 is attached to lower valve seat carrier 106 and may be said to be operably associated with lower valve seat carrier 106 so that upper and lower positions of the upper moving mandrel portion 128 correspond to upper and lower positions of the lower valve seat holder 106 relative to housing 66.

The lower position of lower valve seat holder 106 as illustrated in FIG. 2B corresponds to the closed position of spherical valve member 92 as illustrated. Upon upward movement of lower valve seat holder 106 relative to housing 66, the spherical valve member 92 is moved axially upward relative to housing 66 and is rotated to its open position as previously described by the engagement of eccentric hole 126 with eccentric lug 118.

The lower valve mandrel portion 140 includes a first uppermost section 142 and a second section 144 connected to the lower end of first section 142 and to a piston housing 402 of a pressure compensating piston assembly 400.

It will be understood by those skilled in the art that when the weight of test string 34 is set down upon housing 66, the lower moving mandrel portion 140 will not move axially relative to casing 16 of the well (see FIG. 1), because of engagement of the packer means 46 (see FIG. 1) with the casing 16.

The packer means 46 is preferably a production type packer which is well known in the art.

When the well testing string 34 is picked up, the housing 66 is moved upward relative to the well casing 16 and accordingly the moving mandrel means 136 is moved downward relative to housing 66 to its said lower position thereby once again closing spherical valve member 92.

Lower moving mandrel portion 140 includes an upper end 156 adapted for engagement with a lower end 158 of upper moving mandrel portion 138, so that when the weight of the test string 34 is set down upon housing 66, the lower moving mandrel portion 140 is moved upward relative to housing 66 and is engaged with upper moving mandrel portion 138 to move the upper moving mandrel portion 138 upward relative to housing 66, thereby opening spherical valve member 92.

The moving mandrel means 136 includes latch means generally indicated by the numeral 160 for latching spherical valve member 92 in its said closed position as the test string 34 is lowered into the well.

Latch means 160 includes a plurality of resilient spring collet fingers such as fingers 162, 164 and 166, extending downward from upper moving mandrel portion 138. Each of said spring collet fingers includes a head 168 at its lower end with radially inner and outer upward facing shoulders 170 and 172, respectively, defined upon the head 168. Shoulders 170 and 172 are tapered.

Latch means 160 further includes an annular radially inner recess means 174 in an inner surface of housing 66. An upper end of said recess means is defined by a downward facing annular shoulder 176 of housing 66. Recess means 174 provides a means for receiving the radially outer upward facing shoulders 172 of the spring collet fingers when the spherical valve member 92 is in its said closed position. Latch means 160 further includes a radially outer cylindrical surface means 178 on first section 142 of lower moving mandrel portion 140 for engaging a radially inner surface 180 of the heads 168 of the spring collet fingers, and holding the heads 168 within the recess means 174 of housing 66 when the spherical valve member 92 is in its closed position.

Additionally, lower moving mandrel portion 140 includes a radially outer annular recess means 182 located below radially outer cylindrical surface 178, for receiving the radially inner upward facing shoulders 170 of heads 168 of the spring collet fingers, such as finger 166, when the upper end 156 of lower moving mandrel portion 140 is in engagement with lower end 158 of upper moving mandrel portion 138.

The purpose of latch means 160 is best understood by describing the functions it accomplishes in sequence as the well test string 34 is lowered into the well, then as the well test string 34 is set down upon the housing 66, and then as the well test string 34 is subsequently picked up.

Figure 2C:
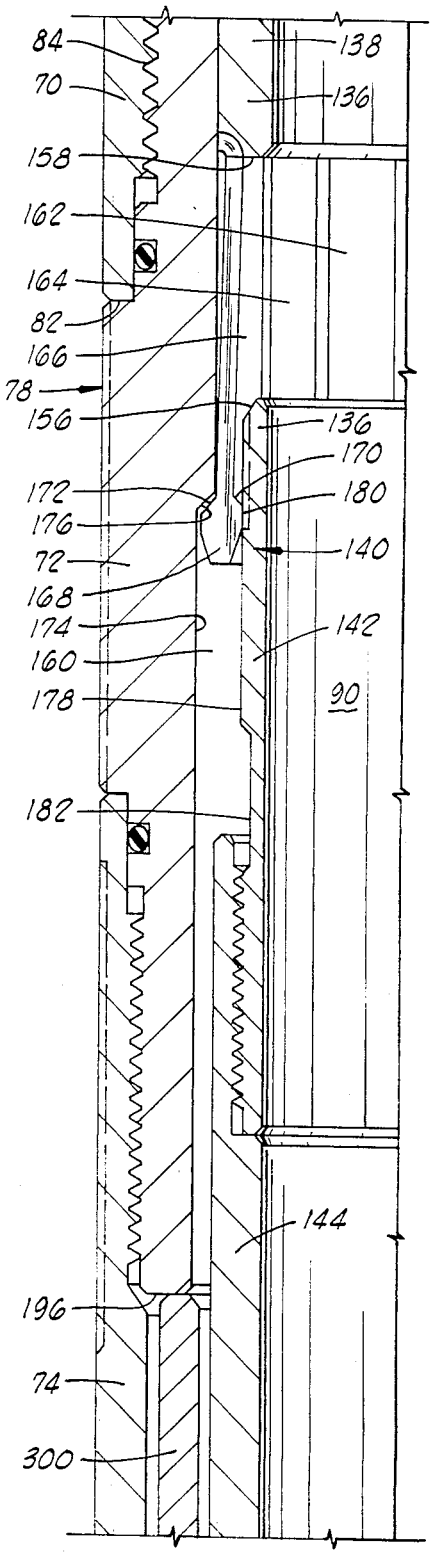
Figure 2D:
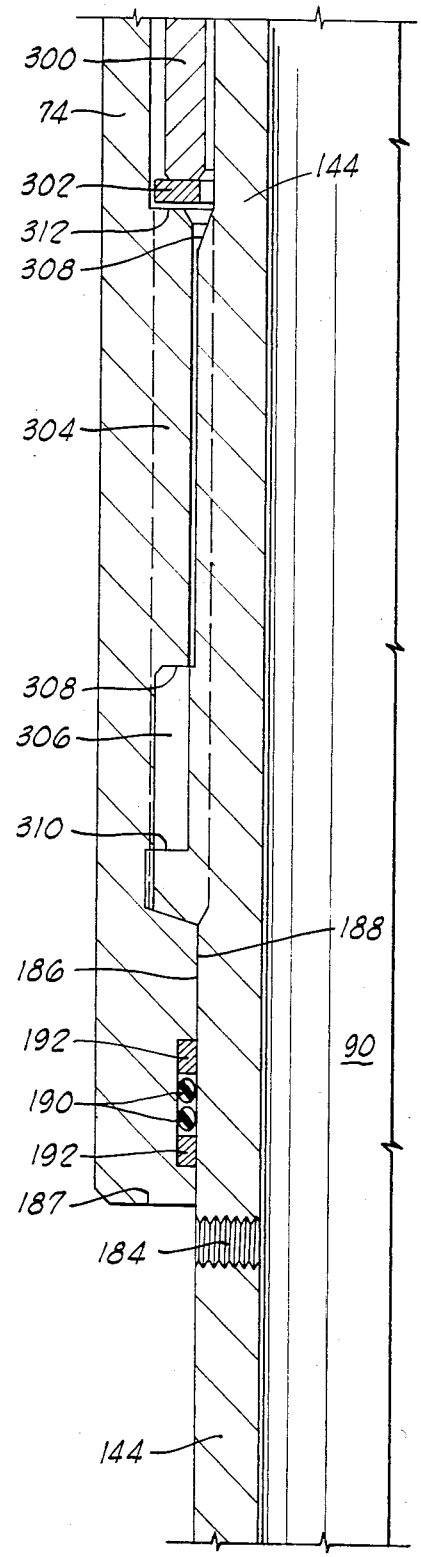

When the well test string 34 is run into the well, the components of the drill pipe tester valve 62, and particularly the latch means 160, are in the relative positions illustrated in FIGS. 2A–2E. As is seen in FIG. 2C, the latch means 160 at this point provides a means for releasably locking upper moving mandrel portion 138 relative to housing 66 in a position holding spherical valve member 92 in its said closed position as the well test string 134 is lowered into a well. This upper moving mandrel portion 138 is locked in the described position due to engagement of outer shoulder 178 of the heads 168 of the collet fingers with the recess 174 of the housing 66, and due to the presence of the radially outward surface 178 of lower moving mandrel portion 140 which holds the heads 168 in the described position.

When the well test string 34 is located in its desired final position within the well, the weight of the test string is set down upon the housing 66 as previously described. During that operation the latch means 160 provides a means for releasing the upper moving mandrel portion 138 relative to housing 66. This releasing function is accomplished by upward movement of lower moving mandrel portion 140 relative to upper moving mandrel portion 138 prior to engagement of the upper end 156 of lower moving mandrel 140 with the lower end of upper moving mandrel portion 138. When the inner shoulders 170 of the heads 168 of the collet fingers become located opposite the radially outer recess 182 of lower moving mandrel portion 140, the heads 168 of the collet fingers are moved radially inward into the recess 182 thereby releasing upper moving mandrel portion 138 from its previously latched engagement with housing 66.

Additionally, as the weight of test string 34 continues to be set down upon housing 66, the latch means 160 provides a means for releasably locking lower moving mandrel portion 140 to upper moving mandrel portion 138. This is accomplished by the receiving of the inner shoulder 170 of heads 168 within recess 182 of lower moving mandrel portion 140 and the subsequent upward movement of both upper and lower moving mandrel portions 138 and 140 relative to housing 66 after the upper end 156 of lower moving mandrel portion 140 engages the lower end 158 of upper moving mandrel portion 138. Additional upward movement of the upper and lower moving mandrel portions relative to housing 66 provides the axial upward movement of valve member 92 necessary to move the same to its open position as previously described.

When the well testing procedures are completed or whenever for some reason the test string 34 is picked up from the well, the latch means 160, due to the fact that it has latched the upper and lower moving mandrel portions 138 and 140 together, provides a means for moving the upper moving mandrel portion 138 downward relative to housing 66 when the well test string is picked up. This is because the lower moving mandrel portion 140 is fixed relative to the casing 16 of the well because of engagement of the packer means 46 with the casing 16. Therefore, since the upper and lower moving mandrel portions are for a time latched together by latch means 160, this causes the upper moving mandrel portion 138 to also be held in position relative to well casing 16 when the well test string 34 is initially picked up.

Subsequently, during the pick up operation, after the upper moving mandrel portion 138 has moved downward relative to housing 66 sufficiently so that lower annular surface 132 of lower valve seat carrier 106 engages upper surface 134 of housing 66, and radially outer shoulder 172 of heads 168 of the collet spring fingers are once again received in the inner recess 174 of housing 66, the lower moving mandrel portion 140 is released from its latched attachment to the upper moving mandrel portion 138 and the components of the drill pipe tester valve 62 are once again in the relative positions illustrated in FIGS. 2A–2E.

Located intermediate the third section 146 of lower moving mandrel portion 140 and second valve casing portion 74 of housing 66 is split resilient "C" ring 300 and thrust washer 302.

Contained on the lower interior surface of the second valve casing portion 74 of housing 66 are a plurality of circumferentially spaced recesses 304 which slidingly contain therein a plurality of circumferentially spaced splines 306 which are present on the exterior of the second section 144 of the lower moving mandrel portion 140. Each spline 306 contains chamfered surface 308 on the upper end thereof to facilitate the sliding of the resilient "C" ring 300 thereon when the weight of the test string is set down on the valve 62. When a predetermined amount of weight of the test string is set down on the valve 62, since the end surface 196 of lower housing portion 78 abuts the end of "C" ring 300 and since the second section 144 of lower moving mandrel portion 140 and second valve casing portion 74 of housing 66 move relative to each other, the resilient "C" ring 300 is forced to expand circumferentially and slide over the outer surfaces of splines 306 thereby allowing relative movement between second section 144 and second valve casing portion 74 until interrupted annular shoulder 308 of second valve casing portion 74 abuts annular shoulder 310 of third section 146.

The amount of force necessary to expand resilient "C" ring 300 causes relative movement between the third section 146 of lower moving mandrel portion 140 and second valve casing portion 74 of housing 66 is controlled by the thickness of the thickness "C" ring 300 and the amount of circumferential expansion required to expand the resilient "C" ring 300 to slide over the splines 306. A conventional coil type spring or other type resilient means may be utilized rather than the resilient "C" ring 300, if desired; however such a coil type spring or resilient member would no longer slide over splines 306 and the required amount of travel to open spherical valve member 92 and close equalization port means 184 would be required between. shoulders 196 and 312.

The second section 144 of lower moving mandrel portion 140 includes an equalization port means 184 disposed through a wall thereof for communicating the flow passage 90 of housing 66 below spherical valve member 92 with the annulus 40 between the test string 34 and the well casing 16 when spherical valve member 92 is in its closed position. The annulus 40 may be generally described as a zone outside of housing 66.

Second section 144 of lower moving mandrel portion 140 further includes an outer cylindrical surface 186 closely received within an inner cylindrical surface 188 of a lower end of second valve casing portion 74 of housing 66.

An annular sealing means 190 is disposed between outer cylindrical surface 186 and inner cylindrical surface 188. Non-metallic backup rings 192 are provided on either side of the annular seals 190. The housing 66, lower moving mandrel portion 140, and annular seal means 190 are so arranged and constructed that when the weight of the test string 34 is set down upon housing 66, and the lower moving mandrel portion 140 is moved upward relative to housing 66, the equalization portion 184 is closed before the spherical valve member 92 is opened.

Equalization port 184 also equalizes the pressure across the walls of moving mandrel 136 to prevent inward collapse thereof due to the hydrostatic head in annulus 40. It also prevents a hydraulic pressure lock from occurring between spherical valve member 92 and the formation tester valve 60 when the moving mandrel means 136 is telescoped into housing 66.

Upward relative movement between second valve casing portion 74 of housing 66 and second section 144 of lower moving mandrel portion 140 causes the resilient "C" ring 300 to be pushed off splines 306 by shoulder 312 of second valve casing portion 74 abutting thrust washer 302 which, in turn, abuts the lower end of resilient "C" ring 300 causing the resilient "C" ring 300 to slide upwardly until the upper end of the resilient "C" ring abuts end surface 196 of housing 66.

Figure 2E:
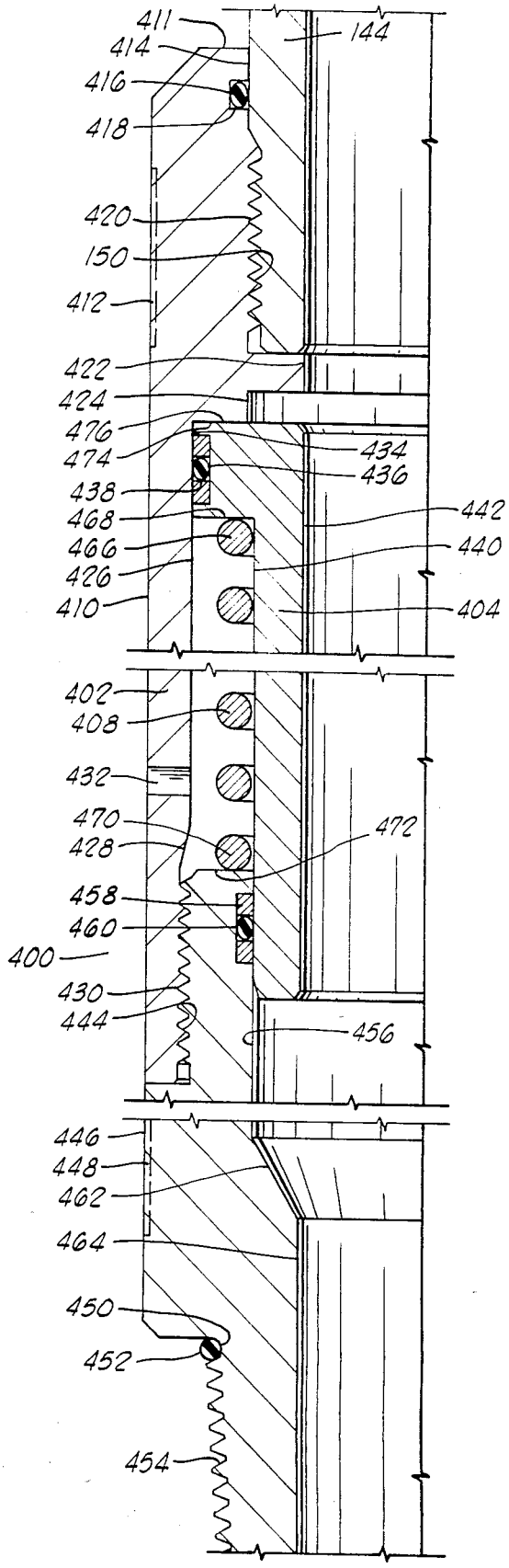

Referring to FIG. 2E, the automatic pressure compensating piston assembly 400 of the tester valve 62 of the present invention is shown.

The automatic pressure compensating piston assembly 400 comprises a piston housing 402, piston 404, lower adapter 406 and spring 408.

The piston housing 402 comprises an elongated annular cylindrical member having, on the exterior thereof, cylindrical surface 410 having, in turn, a plurality of wrenching flats 412 therein and, on the interior thereof, first bore 414 having, in turn, annular recess 416 therein containing annular elastomeric seal 418 therein, first threaded bore 420 which threadedly, releasably engages threaded end surface 150 of second section 144, second bore 422, third bore 424, fourth bore 426, frusto-conical annular portion 428, and second threaded bore 430. The piston housing 402 further includes at least one aperture or port 432 therethrough to allow fluid communication between the exterior of the housing 402 and the interior thereof, specifically, fourth bore 426.

The piston 404 comprises an elongated annular cylindrical member having, on the exterior thereof, first cylindrical surface 434 having, in turn, annular recess 436 therein containing annular elastomeric seal 438 therein which slidingly, sealingly engages fourth bore 426 of piston housing 402 and second cylindrical surface 440 and, on the interior thereof, bore 442.

The lower adapter 406 comprises an elongated annular cylindrical member having, on the exterior thereof, first threaded surface 444 which threadedly, releasably engages second threaded bore 430 of piston housing 402, cylindrical surface 446 having, in turn, a plurality of wrenching flats 448 therein, annular recess 450 having, in turn, annular elastomeric seal 452 therein and second threaded surface 454 and, on the interior thereof, first bore 456 having, in turn, annular recess 458 therein containing annular elastomeric seal 460 therein which slidably, sealingly engages second cylindrical surface 440 of piston 404, frustoconical annular portion 462 and second bore 464.

The spring 408 comprises an annular coil type wound spring disposed about second cylindrical surface 440 of piston 402 having one end 466 thereof abutting annular shoulder 468 between first cylindrical surface 434 and second cylindrical surface 440 of piston 404 and the other end 470 abutting annular end surface 472 of adapter 406 to resiliently bias end surface 474 having annular grooves therein of piston 404 into engagement with annular shoulder 476 of piston housing 402.

OPERATION OF THE INVENTION

Referring to FIG. 1 and FIGS. 2A–2E, the methods of utilizing the drill pipe tester valve 62 of the present invention are generally as follows.

The purpose of the drill pipe tester valve is to allow the drill pipe to be pressure tested periodically as it is lowered into the well to determine whether there are any leaks between successive joints of drill pipe.

The drill pipe tester valve of the present invention is generally run directly above a formation tester valve 60 such as the formation tester of Holden et al, disclosed in U.S. Pat. No. 3,856,085. The use of the drill pipe tester valve of the present invention provides a method for testing the drill pipe without exerting the test pressures upon the spherical valve member of the formation tester valve 60 (see FIG. 1) with the problems accompanied therewith as previously described, and also provides a safety feature.

The drill pipe tester valve 62 is attached to a lower end of a string of pipe, and below the drill pipe tester valve 62 is connected to the formation tester valve 60 and a packer means 46 generally as shown in FIG. 1.

The string of pipe or the well test string 34 is then lowered into the well. The string of pipe above the spherical valve member 92 is filled with fluid by filling from the work deck 26.

Periodically, during the lowering operation, the lowering is stopped and the string of pipe is located statically within the well. Then the string of pipe is pressure tested while the string of pipe is stopped and while the spherical valve member is in its closed position. This stopping is done periodically so that successive portions of the string of pipe are pressure tested periodically as the string of pipe is lowered into the well.

During the pressure testing operation, the lower valve seat holder 106 is supported against downward force exerted upon spherical valve member 92 by pressure testing of the pipe, from the housing 66 by engagement of the downward facing surface 132 of lower valve seat holder 106 with the upward facing annular surface 134 of housing 66.

The upper moving mandrel portion 138 is locked relative to the housing 66 by latch means 160 thereby holding the spherical valve member 92 in the closed position while the string of pipe is being lowered into the well. When the string of pipe is finally positioned within the well and the weight of the string of pipe is set down upon the housing 66, the upper moving mandrel portion of the drill pipe tester valve 62 is released relative to the housing 66 and the lower moving mandrel portion is locked to the upper moving mandrel portion. Although upper moving mandrel portion 138 should be locked relative to the housing 66 by latch means 160 holding the spherical valve member 92 in the closed position to prevent contamination of the fluid in the string of pipe above valve 62, to insure that the member 92 remains closed until its desired opening the resilient "C" ring 300 is included in the drill pipe tester valve 62.

Since the tester valve 62 of the present invention includes pressure compensating piston assembly 400, when weight is set down on the string of pipe to open spherical valve member 92, since apertures 184 in second section 144 are closed or sealed off by second valve casing 74 before lower end surface 187 thereof abuts upper end surface 411 of piston housing 402 and since the formation tester valve 60 located below the tester valve 62 of the present invention is also closed, the pressure compensating piston assembly 400 compensates for the decrease in volume of the tester valve 62 from the time the apertures or ports 184 are sealed or closed during setting down weight on the tester valve 62 before the spherical valve member 92 therein begins to open.

The pressure compensating piston assembly 400 compensates for the volume decrease in the tester valve 62 by the increasing pressure after ports 184 are closed or sealed within tester valve 62 causing the piston 404 to move downwardly or away from annular shoulder 476 in piston housing 402. Since the interior of tester valve 62 is at hydrostatic pressure due to ports 184 in second section 144 allowing fluid communication between the exterior of the tester valve 62 and the interior thereof below closed spherical valve member 92 and since the piston 404 has the same hydrostatic pressure on the exterior thereof via apertures or ports 432 in piston housing 402, after the ports 184 are closed or sealed by valve case 74, the pressure within the tester valve 62 below closed spherical valve member 92 need only increase to a level sufficient to overcome the force of spring 408 and friction of seal 436 to cause movement of the piston 404 within piston housing 402 to compensate for the volume decrease of the tester valve during setting weight thereon. Also, when the spherical valve member 92 opens in the tester valve 62, if hydrostatic fluid pressure on the exterior of the tester valve 62 is higher than that of the fluid pressure in tester valve 62, the piston 404 will automatically be moved upwardly within piston housing 402 by the higher exterior hydrostatic fluid pressure communicating via ports 432 in housing 402 to bias end surface 474 of piston 404 into annular surface 476 of piston housing 402. Since end surface 474 of piston 404 is grooved, a metal to metal seal is formed between the piston 404 and piston housing 402.

Then upon picking up the string of pipe after the testing procedure is completed, or whenever it is necessary to pick up the string of pipe for some other reason, the upper moving mandrel portion is moved downward relative to the housing 66, thereby closing the spherical valve member 92, and the upper moving mandrel portion is released from its latched attachment to the lower moving mandrel portion 140.

Also, the packer means 46 is provided below the drill pipe tester valve for sealing the annulus 40 between the test string 34 and the well casing 16.

Thus, it is seen that the Drill Pipe Tester and Safety Valve of the present invention readily achieves the ends and advantages mentioned as well as those inherent therein. While presently preferred embodiments of the invention have been illustrated for the purposes of this disclosure, numerous changes in the arrangement and construction of parts may be made by those skilled in the art, which changes are encompassed by the scope and spirit of this invention as defined by the appended claims.

What is claimed is:

1. A pipe tester valve comprising:

a housing having a first end adapted to be connected to a string of pipe, and having a flow passage therethrough;

a spherical valve member disposed in said flow passage of said housing;

lug means, attached to said housing, for engaging said spherical valve member and rotating said spherical valve member between open and closed positions wherein said flow passage is open and closed, respectively, as said spherical valve member is moved axially relative to said housing and said lug means;

moving means for moving said spherical valve member axially relative to said housing between the open and the closed positions; and an automatic pressure compensating piston assembly connected to the moving means to compensate for any decrease in the volume of said pipe tester valve during the actuation thereof.

2. The pipe tester valve of claim 1 wherein the automatic pressure compensating piston assembly comprises:

a piston housing;

a piston slidably disposed within the piston housing;

a lower adapter connected to the piston housing; and a spring resiliently biasing the piston within the piston housing.

3. A pipe tester valve comprising:

a housing having a first end adapted to be connected to a string of pipe, and having a flow passage therethrough;

a spherical valve member disposed in said flow passage of said housing;

lug means, attached to said housing, for engaging said spherical valve member and rotating said spherical valve member between open and closed positions wherein said flow passage is open and closed, respectively, as said spherical valve member is moved axially relative to said housing and said lug means;

moving means for moving said spherical valve member axially relative to said housing between the open and the closed positions, said moving means including:

lower valve member seat means having a downward facing surface supportably engaged by an upward facing surface of said housing when said spherical valve member is in its closed position, so that downward forces exerted on said spherical valve member in the closed position due to fluid pressure in said string of pipe above said spherical valve member are transmitted to said housing through the engagement of said downward facing surface and said upward facing surface;

upper moving mandrel portion attached to said lower valve member seat means;

lower moving mandrel portion having an upper end adapted for engagement with a lower end of the upper moving mandrel portion whereby when a predetermined amount of force is applied to said housing by a predetermined amount of the weight of said string of pipe being set down on said housing said lower moving mandrel portion being moved upward relative to said housing and is engaged with said upper moving mandrel portion to move said upper moving mandrel portion upward relative to said housing thereby opening said spherical valve member;

latch means for latching said spherical valve member in the closed position, said latch means including first locking means for releasably locking said upper moving mandrel portion relative to said housing in a position holding said spherical valve member in the closed position; and an automatic pressure compensating piston assembly connected to the lower moving mandrel portion of the moving means.

4. The pipe tester valve of claim 3 wherein the moving means further comprises:

resilient means interposed between said housing abutting a portion thereof and said moving means abutting a portion thereof thereby preventing movement of said moving means with respect to said housing until a predetermined amount of force is applied by said string of pipe by setting a predetermined amount of weight of said string of pipe on said housing.

5. The pipe tester valve of claim 3 wherein the automatic pressure compensating piston assembly comprises:

a piston housing;

a piston slidably disposed within the piston housing;

a lower adapter connected to the piston housing; and a spring resiliently biasing the piston within the piston housing.

6. The pipe tester valve of claim 4 wherein:

said housing including longitudinal channel means disposed about a portion of the interior thereof; and said lower moving mandrel portion having spline means on a portion of the exterior thereof which slidingly engage the longitudinal channel means of said housing.

7. The pipe tester valve of claim 6 wherein:

said resilient means comprises resilient "C" ring means which slidably engage a portion of the exterior surface of the splines on said lower mandrel when a predetermined amount of the weight of said string of pipe is set down on said housing.

8. A pipe tester valve comprising:

a housing having a first end adapted to be connected to a string of pipe, having a flow passage therethrough and having longitudinal channel means disposed about a portion of the interior thereof;

a spherical valve member disposed in said flow passage of said housing;

lug means, attached to said housing, for engaging said spherical valve member and rotating said spherical valve member between open and closed positions wherein said flow passage is open and closed, respectively, as said spherical valve member is moved axially relative to said housing and said lug means;

moving means for moving said spherical valve member axially relative to said housing between the open and the closed positions, said moving means including:

lower valve member seat means having a downward facing surface supportably engaged by an upward facing surface of said housing when said spherical valve member is in its closed position, so that downward forces exerted on said spherical valve member in the closed position due to fluid pressure in said string of pipe above said spherical valve member are transmitted to said housing through the engagement of said downward facing surface and said upward facing surface;

upper moving mandrel portion attached to said lower valve member seat means;

lower moving mandrel portion having an upper end adapted for engagement with a lower end of the upper moving mandrel portion and having spline means on a portion of the exterior thereof which slidingly engage the longitudinal channel means of said housing whereby when a predetermined amount of force is applied to said housing by a predetermined amount of weight of said string of pipe being set down on said housing said lower moving mandrel portion being moved upward relative to said housing and is engaged with said upper moving mandrel portion to move said upper moving mandrel portion upward relative to said housing thereby opening said spherical valve member;

latch means for latching said spherical valve member in the closed position, said latch means including first locking means for releasably locking said upper moving mandrel portion relative to said housing in a position holding said spherical valve member in the closed position; and resilient "C" ring means interposed between said housing abutting a portion thereof and said moving means abutting a portion thereof thereby preventing movement of said moving means with respect to said housing until a predetermined amount of force is applied by said string of pipe by setting a predetermined amount of weight of said string of pipe on said housing whereby said resilient "C" ring means expands and slidably engages a portion of the exterior surface of the splines on said lower mandrel when said lower mandrel moves upward relative to said housing thereby opening said spherical valve member; and an automatic pressure compensating piston assembly connected to the lower moving mandrel portion of the moving means, the automatic pressure compensating piston assembly comprising:

a piston housing connected to one end of the lower moving mandrel portion of the moving means;

a piston slidably disposed within the piston housing;

a lower adapter connected to the piston housing; and a spring resiliently biasing the piston within the piston housing.

* * * * *